US007523530B2

(12) United States Patent
Muromachi

(10) Patent No.: US 7,523,530 B2
(45) Date of Patent: Apr. 28, 2009

(54) BUCKLE DEVICE

(75) Inventor: Tetsushi Muromachi, Aichi-ken (JP)

(73) Assignee: Kabushiki Kaisha Tokai-Rika-Denki-Seisakusho, Aichi-ken (JP)

( * ) Notice: Subject to any disclaimer, the term of this patent is extended or adjusted under 35 U.S.C. 154(b) by 195 days.

(21) Appl. No.: 11/582,450

(22) Filed: Oct. 18, 2006

(65) Prior Publication Data

US 2007/0084026 A1 Apr. 19, 2007

(30) Foreign Application Priority Data

Oct. 19, 2005 (JP) ..... 2005-304552

(51) Int. Cl.
*A44B 11/25* (2006.01)

(52) U.S. Cl. ..... 24/636; 24/641

(58) Field of Classification Search ..... 24/629, 24/633, 636, 637, 641, 643, 645
See application file for complete search history.

(56) References Cited

U.S. PATENT DOCUMENTS 3,760,467 A * 9/1973 Lohr ..... 24/639
4,454,634 A * 6/1984 Haglund et al. ..... 24/636
6,367,129 B1 * 4/2002 Mori ..... 24/641
6,438,810 B2 * 8/2002 Rogers et al. ..... 24/641
6,746,048 B2 * 6/2004 Tajima et al. ..... 280/801.1

FOREIGN PATENT DOCUMENTS

EP 1 018 307 A1 7/2000
EP 1 266 587 A1 12/2002
JP 2003-125811 A 5/2003

* cited by examiner

*Primary Examiner*—Robert J Sandy
(74) *Attorney, Agent, or Firm*—Roberts Mlotkowski Safran & Cole, P.C.; Thomas W. Cole

(57) ABSTRACT

A buckle device is provided with a lock plate that engages with a tongue plate that is inserted into the device body and that holds the tongue plate inside the device body, and a lock member that engages with the lock plate and prevents the lock plate from moving to a released position, and the lock member has a body portion and a shaft that supports the body portion within the device body. The body portion of the lock member is formed from a sintered metal, and the shaft is formed from a metal and is integrally press fit into the body portion. The strength of the shaft, which receives the load of the body portion, is secured and at the same time it is possible to achieve miniaturization and weight securement of the body portion.

8 Claims, 4 Drawing Sheets

10
12
14
16
18
20
22
24
26
26A
28
30
32
34
36
38
40
42
44
46
48
50
52
54
56
56A
56B
58
62
64
70
72
74
75
76
78
80
82
84
86
A
B
C
D

BUCKLE DEVICE

CROSS-REFERENCE TO RELATED APPLICATION

This application claims priority under 35 USC 119 from Japanese Patent Application No. 2005-304552, the disclosure of which is incorporated by reference herein.

BACKGROUND OF THE INVENTION

1. Field of the Invention

The present invention relates to a buckle device that structures a vehicle seat belt device and holds a tongue plate attached to webbing.

2. Description of the Related Art

Buckle devices currently known include, for example, a buckle device provided with a lock plate that is rotatably supported at the device body and that holds a tongue plate at the device body by approaching and engaging with a tongue plate inserted into the device body, and a lock member that engages with the lock plate in the above-described state of engagement and prevents separation of the lock plate from the tongue plate (see, for example, Japanese Patent Application Laid-Open (JP-A) No. 2003-125811).

In this kind of buckle device, when a release button mounted at the device body is operated by pressing, the lock member oscillates, allowing the separation of the lock plate from the tongue plate, and the holding of the tongue plate is thus released.

Incidentally, in buckle devices similar to that described above, the lock member is manufactured by fixing together with rivets two parts (a body portion and a counter-mass) formed by press working, and by having the lock member supported at the device body by a spindle part that is formed to project from one press worked part (the body portion), the lock member can oscillate around the spindle part. Further, in this kind of lock member, the two press worked parts are provided with a specified weight so as to achieve the so-called "counter effect".

However, while there is a demand for miniaturization of buckle devices, limitations to the width dimensions of the lock member have made it difficult to secure the weight of the lock member.

SUMMARY OF THE INVENTION

The present invention takes the above factors into consideration and aims to attain a buckle device that can secure required strength and achieve both miniaturization and weight securement of the lock member.

In order to address the above problems, the buckle device of a first aspect of the invention includes a lock plate provided so as to be movable between an engagement position, at which the lock plate engages with a tongue plate inserted into a body of the device and holds the tongue plate within the body of the device, and a released position, at which the lock plate has been released from holding the tongue plate, and a lock member having a body portion provided so as to be able to oscillate between a locking position, at which the body portion engages with the lock plate positioned at the engagement position and prevents the lock plate from moving toward the released position, and an unlocked position, at which the body portion has been released from preventing movement of the lock plate, and a shaft that supports the body portion at the body of the device, with the body portion being formed from a sintered metal and the shaft being formed from a metal and integrally press fit into the body portion.

In the buckle device of the above aspect, when the tongue plate is inserted into the device body, the lock plate moves toward the engagement position and engages with the tongue plate, and the tongue plate is held inside the device body. In addition, the body portion of the lock member oscillates toward the locking position, engages with the lock plate and prevents the lock plate from moving toward the released position. As a result, an attached state of the tongue plate with respect to the present buckle device is achieved.

On the other hand, in the buckle device of the above aspect, when a release button provided at the device body is operated, the body portion of the lock member oscillates toward the unlocked position and the lock member is released from preventing the lock plate from moving. As a result, the lock plate moves to the released position and the lock plate is released from holding the tongue plate.

In the present buckle device, the body portion of the lock member is formed from a sintered metal, and the shaft that supports the body portion at the device body is formed from a metallic material (for example, stainless steel) and is integrally press fit into the body portion. Accordingly, the strength of the shaft, on which the load of the body portion acts, can be secured and it is also possible to achieve both miniaturization and weight securement of the body portion.

In the buckle device according to the above first aspect, a release button that is provided at the body of the device and that causes the body portion of the lock member to oscillate toward the unlocked position when the release button is operated by being pressed, a lock spring that is provided between the release button and the body portion of the lock member and that urges the body portion of the lock member toward the locking position, and a holder, formed from a resin, that is provided between the body portion of the lock member and the lock spring and is engaged with one end of the lock spring, may also be provided.

In the above structure, the lock spring provided between the release button and the body portion of the lock member urges the body portion of the lock member toward the locking position. One end of the lock spring is engaged with a holder that is formed from a resin and provided between the body portion of the lock member and the lock spring. Accordingly, even if the one end of the lock spring and the holder are in friction with each other when the body portion of the lock member oscillates, wear of the lock spring can be prevented and the durability of the lock spring is improved.

As explained above, in the buckle device according to the present invention, required strength is secured and it is also possible to achieve both miniaturization and weight securement of the lock member.

DETAILED DESCRIPTION OF THE INVENTION

Figure 3:
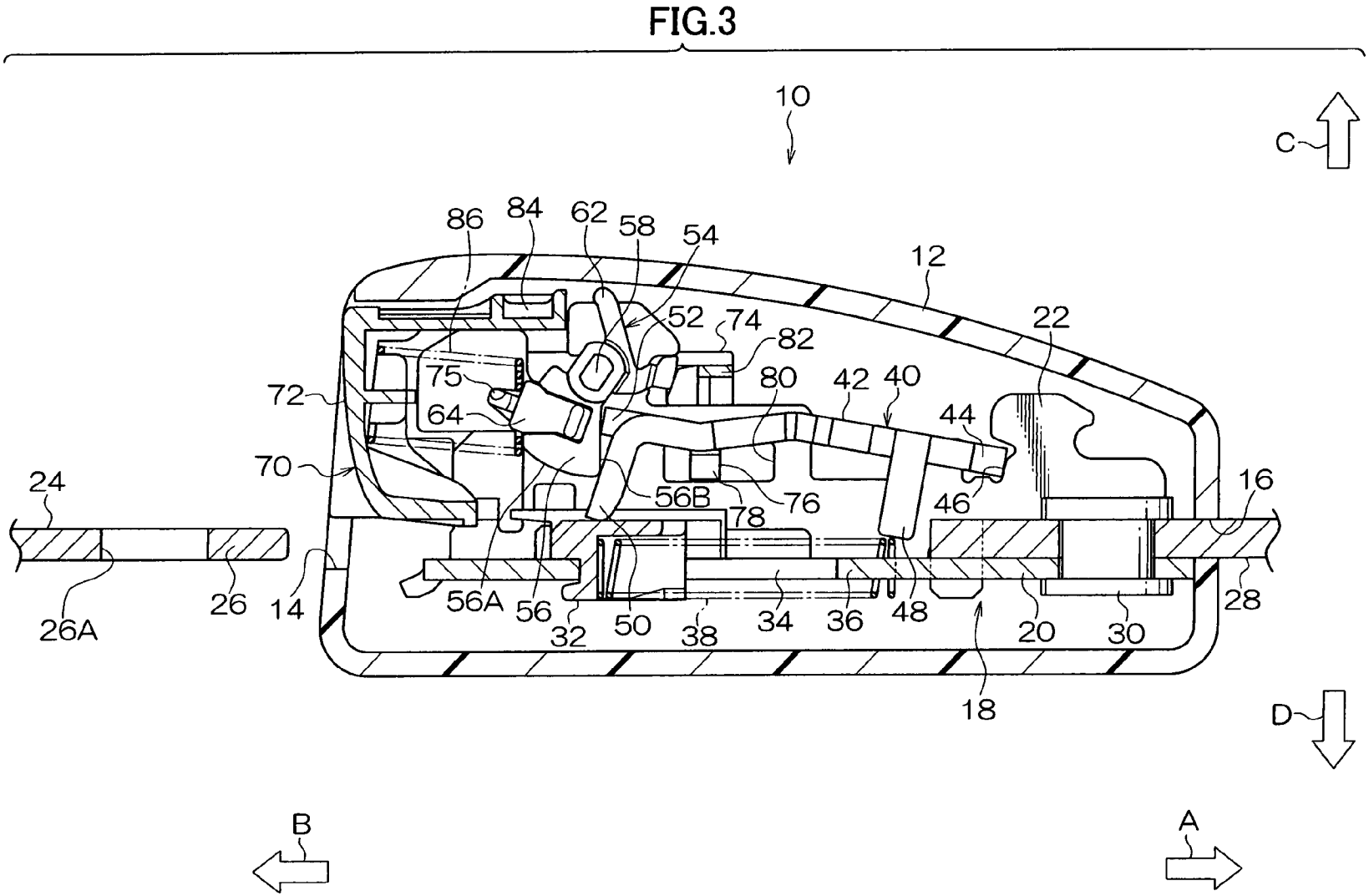
FIG. 3 is a sectional view showing the overall configuration of a buckle device according to an embodiment of the present invention.
Figure 4:
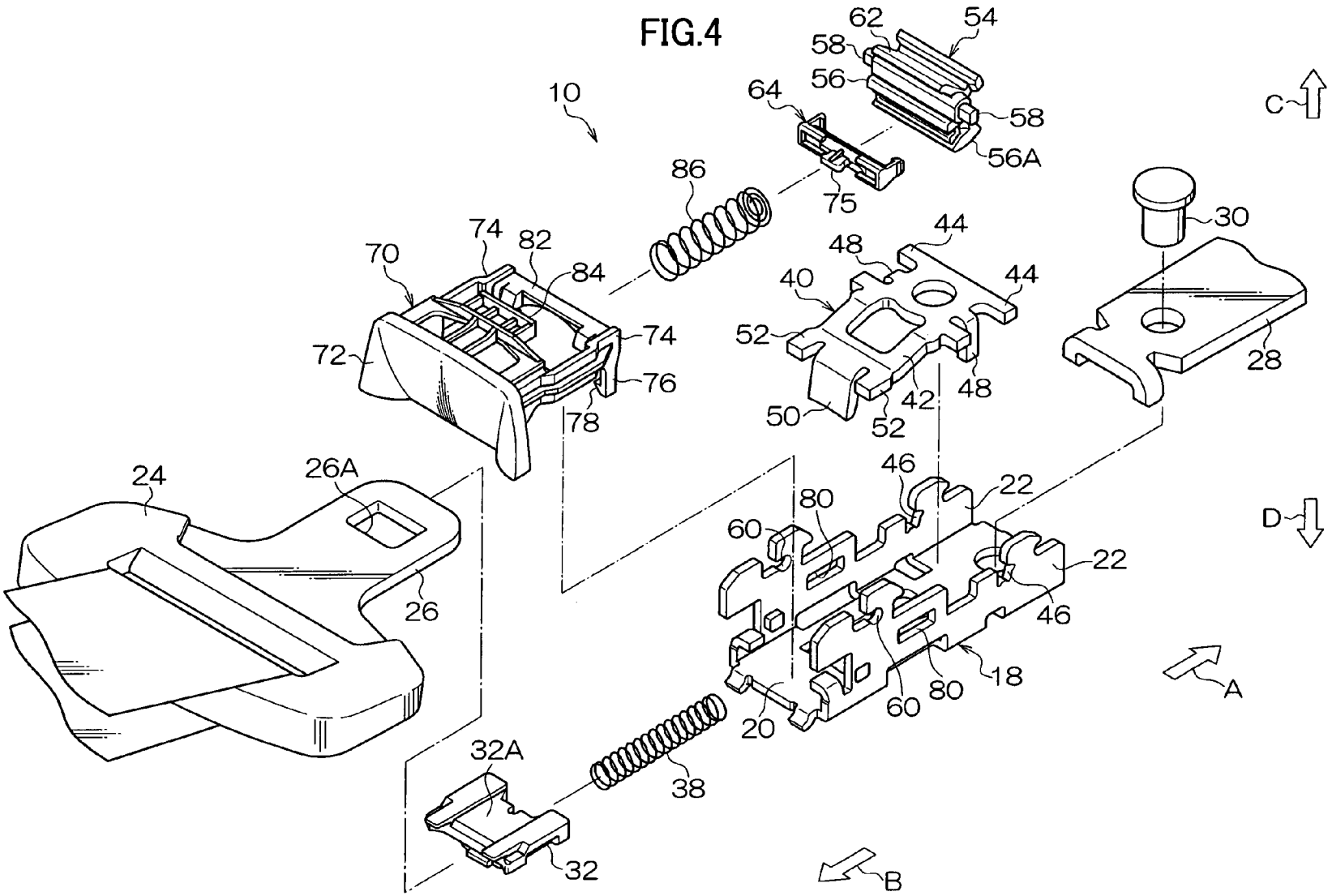
FIG. 4 is an exploded perspective view showing the overall structure of a buckle device according to an embodiment of the present invention.

In FIG. 4, the structure of a buckle device 10 according to an embodiment of the present invention is illustrated in exploded perspective view. Further, in FIG. 3, the structure of the buckle device 10 is illustrated in sectional view.

As shown in FIG. 3, the buckle device 10 is provided with a case 12. The case 12 is formed as a box-shaped cylinder having an opening at either end in a length direction, with the opening at one end in a length direction being a tongue insertion opening 14 and the opening at the other end length direction being an anchor insertion opening 16. Further, a buckle body 18 that structures the device body is accommodated at an inner side of the case 12.

The buckle body 18 has a bottom plate part 20 formed in a long flat plate shape along the length direction of the case 12 and a pair of side wall parts 22 extending integrally from both sides in a width direction of the bottom plate part 20 toward one side in a plate-thickness direction of the bottom plate part 20 (the side in the direction of Arrow C), and as a whole is formed with an open-top box-shaped cross section. At the buckle body 18, an insertion plate part 26 of a tongue plate 24 that is inserted from the tongue opening 14 of the case 12, is inserted between the pair of side wall parts 22 from one end side in a length direction of the bottom plate part 20 (the side in the direction of Arrow B).

Further, the front edge part of an anchor plate 28 that is inserted from the anchor opening 16 of the case 12 is overlaid at the other end side in a length direction of the bottom plate part 20 (the side in the direction of Arrow A), and the bottom plate part 20 and the anchor plate 28 are coupled together and fixed by a rivet 30 that passes through the bottom plate part 20 and the anchor plate 28. The anchor end side of the anchor plate 28 is fixed at the vehicle body at the seat side of the vehicle (both omitted from the drawings) and, in this way, the present buckle device 10 is attached to the vehicle.

In addition, an ejector 32 is disposed between the pair of side wall parts 22. A part of the ejector 32 is engaged with a substantially rectangular through hole 34 formed at the bottom plate part 20. The through hole 34 is formed to be long in the length direction of the bottom plate part 20 and the ejector 32 is able to slide within a predetermined range in the length direction of the bottom plate part 20 along the through hole 34.

At an inner peripheral part of one end side in a length direction of the through hole 34 (the side in the direction of Arrow A), an engagement projection 36 is formed so as to protrude, and is engaged with one end of an ejector spring 38, which is a compression coil spring. The other end of the ejector spring 38 is engaged with the ejector 32 and the ejector 32 is urged toward one end side in a length direction of the bottom plate part 20 (the side in the direction of Arrow B) by the urging force of the ejector spring 38.

Figure 2:
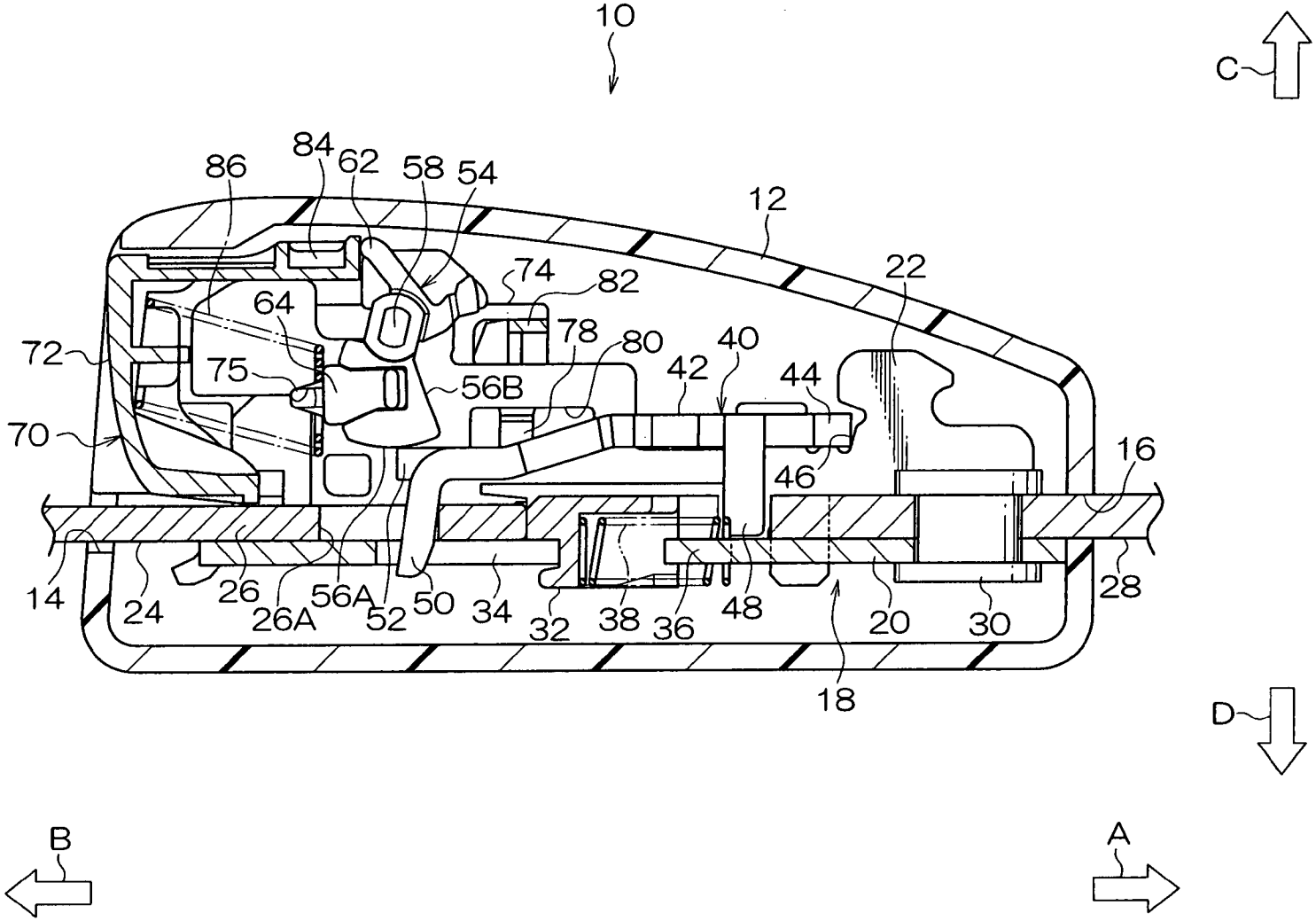
FIG. 2 is a sectional view showing the overall configuration of a buckle device according to an embodiment of the present invention.

The ejector 32 is slid toward the other end side in a length direction of the bottom plate part 20 against the urging force of the ejector spring 38 when it is pushed by the insertion plate part 26 of the tongue plate 24 inserted between the pair of side wall parts 22 (the state shown in FIG. 2).

On the other hand, the present buckle device 10 is provided with a lock plate 40. The lock plate 40 is provided with a base part 42 formed in a long plate-shape along the length direction of the bottom plate part 20. A pair of support parts 44 are formed so as to project toward either side in a width direction at the anchor end of the base part 42 (the end part at the side in the direction of Arrow A). The pair of support parts 44 penetrate support holes 46 formed at the respective side wall parts 22 of the buckle body 18, and the lock plate 40 is supported by the pair of side wall parts 22 so as to be rotatable around the pair of support parts 44 (the support holes 46) to a predetermined angle.

Further, at the anchor end side of the base part 42, a pair of arm parts 48 extend from either edge in a width direction toward the bottom plate part 20 side (the side in the direction of Arrow D). The pair of arm parts 48 are formed such that the respective leading end sides are positioned above the slide trajectory of the ejector 32, and when the ejector 32 slides toward the other end side in a length direction of the bottom plate part 20 (the Arrow A direction side), the pair of arm parts 48 are pushed toward the other end side in a length direction of the bottom plate part 20 and the base part 42 (the lock plate 40) rotates toward the bottom plate part 20 side (the Arrow D direction side; engagement position).

An engagement piece 50 extends from the front edge of the base part 42 (the edge part at the Arrow B direction side) toward one side in a plate thickness direction of the base part 42 (the bottom plate part side; Arrow D direction side). The engagement piece 50 is formed such that the leading edge side thereof (the Arrow D direction side) is slightly inclined toward the one end side in a length direction of the bottom plate part 20 (the Arrow B direction side). Further, the leading edge part of the engagement piece 50 corresponds to the through hole 34 formed at the bottom plate part 20, and when the lock plate 40 is rotated toward the bottom plate part 20 side (the engagement position) the engagement piece 50 passes through the through hole 34 and an engagement hole 26A in the insertion plate part 26 inserted between the pair of side wall parts 22, and restricts removal of the tongue plate 24 (supports the tongue plate 24) (the state shown in FIG. 2).

A mounting part 32A is formed at a surface at one side in a thickness direction (the Arrow C direction side) of the ejector 32 so as to correspond to the engagement piece 50 of the lock plate 40. In a state in which the tongue plate 24 is not inserted between the pair of side wall parts 22, i.e., in a state in which the ejector 32 is supported by the urging force of the ejector spring 38 at the other side in a length direction (the Arrow B direction side) of the through hole 34, the mounting part 32A intervenes with the leading edge part of the engagement piece 50 and restricts rotation of the lock plate 40 toward the bottom plate part 20 side (the engagement position) (supports the lock plate 40 in a released position) (the state shown in FIG. 3).

In addition, a pair of contact pieces 52 are provided at either side in a width direction of the engagement piece 50 so as to extend from the front edge of the base part 42 toward the one end side (the Arrow B direction side) in a length direction of the bottom plate part 20. The pair of contact pieces 52 correspond to a lock member 54.

Figure 1:
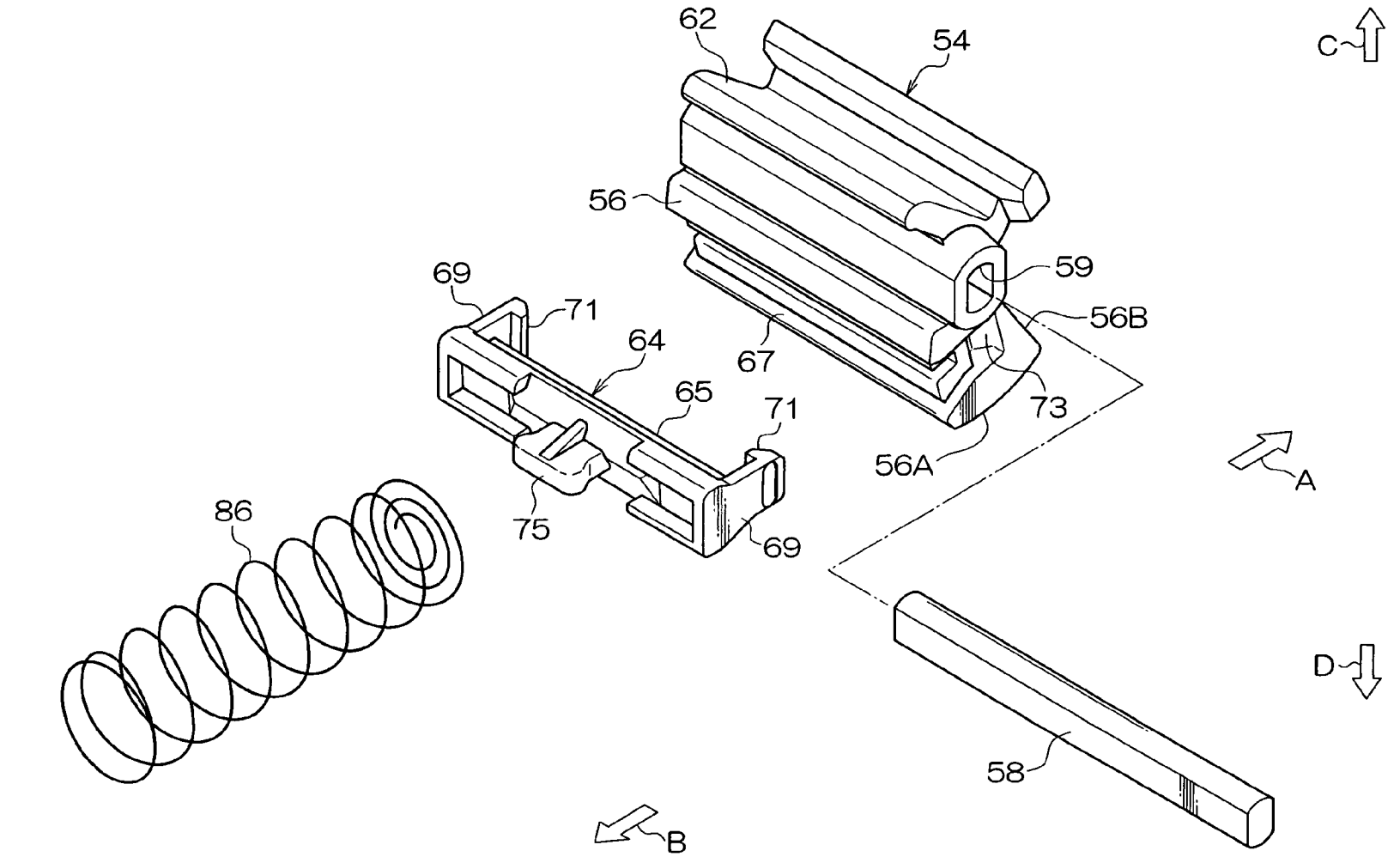
FIG. 1 is an exploded perspective view showing the structure of a lock member, a holder and a lock spring of a buckle device according to an embodiment of the present invention.

The lock member 54 is disposed at an opposite side to the bottom plate part 20 via the pair of contact pieces 52 and, as shown in FIG. 1, is provided with a body portion 56. The body portion 56 is a sintered metal manufactured by the powder metallurgy method and is formed in a substantially triangular cylindrical shape having a length direction along a direction opposed to the pair of side wall parts 22.

Further, the lock member 54 is provided with a shaft 58 that passes through the upper edge part (the edge part at the Arrow C direction side) of the body portion 56 along a length direction thereof. The shaft 58 is formed in a rod shape having a substantially rectangular cross section (a double D-cut shape) from a metallic material (stainless steel in the present embodiment). The shaft 58 is provided so as to be integrally press fit into a press fit hole 59 having a substantially rectangular cross section (a double D-cut shape) formed at the upper edge part of the body 56. The respective end parts in an axial direction of the shaft 58 project from either end in a length direction of the body 56 and penetrate engagement holes 60 formed at the pair of side wall parts 22 such that the body 56 is supported at the pair of side wall parts 22 so that it can oscillate integrally with the shaft 58.

A substantially plate-shaped pressed part 62 is integrally formed at the upper edge side of the body portion 56 (the opposite side to the bottom plate part; the Arrow C direction side) so as to extend toward the side opposite to the bottom plate part 20 (the Arrow C direction side). The pressed part 62 corresponds to a release button 70 described in the following.

Further, a lock surface 56A is formed at the lower edge side (the bottom plate part 20 side; the Arrow D direction side) of the body portion 56, which is formed in a circular arc shape concentric with the shaft 58. In a state in which the lock plate 40 is disposed in the engagement position and the lock member 54 is disposed in the locking position (the state shown in FIG. 2), the lock surface 56A contacts against the upper surfaces (the surfaces at the Arrow C direction side) of the contact pieces 52 of the lock plate 40.

In addition, a contact surface 56B is formed at the side of one edge in a thickness direction (the Arrow A direction side) of the body portion 56. In a state in which the lock plate 40 is disposed in the released position and the lock member 54 is disposed in the unlocked position (the state shown in FIG. 3), the contact surface 56B contacts against the front edges of the contact pieces 52 of the lock plate 40.

Further, as shown in FIG. 1, a holder 64 is mounted at the other side in a thickness direction (the Arrow B direction side) of the body portion 56. The holder 64 is formed from a resin material and is provided with a base 65. The base 65 is formed lengthwise along the length direction of the body portion 56 and is inserted into a mounting groove 67 formed at the body portion 56.

A pair of latch parts 69 extend from either side in a length direction of the base 65 toward one edge side in a width direction (the Arrow A direction side) of the body portion 56. Claw parts 71 are formed to extend from the respective leading ends of the pair of latch parts 69 toward an inner side (the body portion 56 side) and the claw parts 71 are inserted into latch holes 73 formed at both end portions in a length direction of the body portion 56 (the latch parts 69 and the claw parts 71 are structured in the manner of a so-called "snap fit"). In this way, the holder 64 is mounted at the body portion 56.

A spring hold part 75 is formed at a central portion in a length direction of the base 65 so as to extend toward the side opposite to the body portion 56 (the Arrow B direction side). The spring hold part 75 corresponds to a lock spring 86 described in the following.

On the other hand, the present buckle device 10 is provided with a release button 70 provided at one end side in a length direction of the buckle body 18. The release button 70 has an operation part 72 that is operated by a passenger pressing it, and the operation part 72 is formed in a box shape that opens toward the other end side in a length direction (the Arrow A direction side) of the buckle body 18.

A pair of arm parts 74 extend from either end in a width direction of the operation part 72 toward the other end side in a length direction (the Arrow A direction side) of the bottom plate part 20. Projecting parts 76 are provided at the respective extremities of the pair of arm parts 74 so as to respectively extend toward the bottom plate part 20 side (the Arrow D direction side). Claw parts 78 are formed at the respective extremities of the pair of projecting parts 76 so as to respectively project toward the side of the respective side wall parts 22 (the inner side) and the claw parts 78 are inserted into long holes 80 respectively formed in the pair of side wall parts 22. Each long hole 80 is formed lengthwise along the direction of insertion of the tongue plate 24 (the Arrow A direction) and each claw part 78 is able to move within a predetermined range along a length direction of the bottom plate part 20 in accordance with an inner peripheral portion of the long holes 80. In this way, the direction of movement (operation direction) of the release button 70 is restricted by the long holes 80 to the length direction of the bottom plate part 20.

Further, a connecting part 82 formed lengthwise along a direction opposing the pair of arm parts 74 in a substantially rod shape bridges across between the respective extremities of the pair of arm parts 74 such that the respective extremities of the pair of arm parts 74 are connected by the connecting part 82.

In addition, at the release button 70, a pressing part 84 is formed at the upper end side (the Arrow C direction side) of the operation part 72 so as to project toward the other end side (the Arrow A direction side) in a length direction of the bottom plate part 20. The pressing part 84 is disposed so as to face the pressed part 62 of the lock member 54 described above, and when the release button 70 is operated by pressing, the pressed part 62 is pushed by the pressing part 84 toward the other end side (the Arrow A direction side) in a length direction of the bottom plate part 20 and the body portion 56 of the lock member 54 oscillates around the shaft 58 toward the one end side (the Arrow B direction side; the unlocked position) in a length direction of the bottom plate part 20.

Further, a lock spring 86, which is a compression coil spring, is disposed between the operation part 72 of the release button 70 and the lock member 54. The holder 64 described above is disposed between one end of the lock spring 86 and the lock member 54, and the spring hold part 75 of the holder 64 is engaged with the one end of the lock spring 86. The other end of the lock spring 86 is press contacted against a lower wall portion of the operation part 72 of the release button 70, and the lock member 54 is urged toward the locking position (the Arrow A direction side; the side opposite to the release button 70) by the urging force of the lock spring 86 via the holder 64.

Next, the mechanism of the present embodiment is explained.

In the buckle device structured as described above, when the insertion plate part 26 of the tongue plate 24 is inserted into the case 12 from the tongue insertion opening 14 from the non-attached state shown in FIG. 3, the leading end of the insertion plate part 26 contacts against and pushes the end of the ejector 32, causing the ejector 32 to slide to one end side in a length direction (the Arrow A direction side) of the through hole 34 against the urging force of the ejector spring 38, as shown in FIG. 2.

When the ejector 32 slides a predetermined amount toward the one end side in a length direction of the through hole 34, the mounting part 32A of the ejector 32 and the engagement piece 50 of the lock plate 40 are released from a state of opposition and the ejector 32 pushes the pair of arm parts 48 of the lock plate 40, causing the lock plate 40 to rotate toward the bottom plate part 20 side (the engagement position).

As a result, the leading edge part of the engagement piece 50 moves into the proximity of the bottom plate part 20. Further, in this state, the engagement hole 26A of the insertion plate part 26 and the through hole 34 formed at the bottom plate part 20 overlap each other. Accordingly, in this state, as shown in FIG. 2, the rotated engagement piece 50 passes through the engagement hole 26A of the insertion plate part 26 and the through hole 34 of the bottom plate part 20.

Further, by rotating the lock plate 40 to the engagement position, the state of contact between the contact pieces 52 of the lock plate 40 and the contact surface 56B of the lock member 54 is released. Then, since the lock member is receiving the urging force of the lock spring 86 via the holder 64, the body portion 56 of the lock member 54 oscillates toward the other end side (the Arrow A direction side; locking position) in a length direction of the bottom plate portion 20 due to the urging force of the lock spring 86 so as to engage with the rotation of the lock plate 40, and the lock surface 56A of the body portion 56 contacts the upper surfaces (the Arrow C direction side surface) of the contact pieces 52 (the state shown in FIG. 2). As a result, rotation of the lock plate 40 toward the released position (rotation of the engagement piece in a direction away from the bottom plate part 20) is restricted and, as a result, an attached state (held state) of the tongue plate 24 with respect to the buckle device is achieved.

On the other hand, when the operation part 72 of the release button 70 is pressed and operated in the above attached state of the tongue plate 24, the pressed portion 62 of the lock member 54 is pushed toward the other end side (the Arrow A direction side) in a length direction of the bottom plate part 20 by the pressing part 84 of the release button 70 and the body portion 56 of the lock member 54 oscillates toward the one end side (the Arrow B direction side; the unlocked position) in a length direction of the bottom plate part 20 against the urging force of the lock spring 86.

As a result, the state of contact between the lock surface 56A of the body portion 56 and the contact pieces 52 of the lock plate 40 is released and the rotation restriction (movement prevention) of the lock plate 40 by the lock member 54 is released. Moreover, since the urging force of the ejector spring 38 is acting on the engagement piece 50 of the lock plate 40 via the ejector 32 and the insertion plate part 26 of the tongue plate 24, a component force acts on the engagement piece 50 in a direction away from the bottom plate part 20. As a result, the lock plate 40 rotates away from the bottom plate part 20 toward the released position due to the component force acting on the engagement piece 50 and the holding of the tongue plate 24 by the engagement piece 50 is released. As a result, the ejector 32 is slid toward the other end side (the Arrow B direction side) in a length direction of the through hole 34 by the urging force of the ejector spring 38 and the insertion plate part 26 of the lock plate 40 is discharged from the insertion opening 14 of the case 12 by the sliding of the ejector 32.

In the buckle device 10 according to the present embodiment the body portion 56 of the lock member 54 is formed from a sintered metal, and the shaft 58 that supports the body portion 56 at the buckle body 18 is formed from a metallic material (stainless steel in the present embodiment) and is press fit integrally into the body portion 56. Accordingly, the strength of the shaft 58, which receives the load of the body portion 56, is sufficiently secured and miniaturization and weight securement of the body portion 56 can both be achieved.

Moreover, since, as described above, the body portion 56 is formed from a sintered metal, the degree of part precision of the body portion 56 is greatly improved over a case where the lock member is formed from pressed parts. As a result, even when, for example, a low-cost coating is applied to the body portion 56, it is possible to secure the function (quality) of the lock member 54 and value engineering (VE) can be achieved.

Further, since conventional buckle devices have been structured such that one end of a lock spring urging a lock member to a locking position is directly engaged with a pressed part lock member (made of iron), the problem existed that the one end (the engaging portion described above) of the lock spring suffered wear due to friction between the one end of the lock spring and the lock member when the lock member oscillates.

In this regard, in the buckle device 10 according to the present embodiment, the holder 64 formed from a resin is mounted at the body portion of the lock member 54 and one end of the lock spring 86 is engaged with the spring hold part 75 of the holder 64. As a result, it is possible to prevent wear of the one end of the lock spring 86 caused by oscillation of the body portion 56 and the durability of the lock spring 86 is greatly improved. As a result, it is possible, for example, to configure a smaller wire diameter for the lock spring 86, to reduce the urging force and to improve the operationality of the release button 70, and the function (quality) of the lock spring 86 can be secured while also achieving a reduction in the cost thereof.

As explained above, in the buckle device 10 according to the present embodiment, miniaturization and weight securement of the lock member 54 can both be achieved while also securing the necessary strength thereof.

What is claimed is:

1. A buckle device, comprising:

a lock plate provided so as to be movable between an engagement position, at which the lock plate engages with a tongue plate inserted into a body of the device and holds the tongue plate within the body of the device, and a released position, at which the lock plate has been released from holding the tongue plate; and a lock member having a body portion provided so as to be able to oscillate between a locking position, at which the body portion engages with the lock plate positioned at the engagement position and prevents the lock plate from moving toward the released position, and an unlocked position, at which the body portion has been released from preventing movement of the lock plate, and a shaft that supports the body portion at the body of the device, wherein the body portion is formed from a sintered metal and the shaft is formed from a metal and is integrally press fit into the body portion.

2. The buckle device of claim 1, further comprising:

a release button that is provided at the body of the device and that causes the body portion of the lock member to oscillate toward the unlocked position when the release button is operated by being pressed;

a lock spring that is provided between the release button and the body portion of the lock member and that urges the body portion of the lock member toward the locking position; and a holder, formed from a resin, that is provided between the body portion of the lock member and the lock spring and is engaged with one end of the lock spring.

3. The buckle device of claim 1, wherein the metal includes stainless steel.

4. A buckle device, comprising:

a lock plate provided so as to be movable between an engagement position, at which the lock plate engages with a tongue plate inserted into a body of the device and holds the tongue plate within the body of the device, and a released position, at which the lock plate has been released from holding the tongue plate; and a lock member having a body portion provided so as to be able to oscillate between a locking position, at which the body portion engages with the lock plate positioned at the engagement position and prevents the lock plate from moving toward the released position, and an unlocked position, at which the body portion has been released from preventing movement of the lock plate, and a shaft that supports the body portion at the body of the device, wherein the body portion is formed from a sintered metal and includes a recess for non-rotatably receiving said shaft.

5. The buckle device of claim 4, wherein the shaft is formed from a metal and is integrally press fit into the body portion.

6. The buckle device of claim 5, wherein the metal includes stainless steel.

7. The buckle device of claim 4, further comprising:

a release button that is provided at the body of the device;

a lock spring that is provided between the release button and the body portion of the lock member; and a holder, formed from a resin, that is provided between the body portion of the lock member and the lock spring.

8. A buckle device, comprising:

a lock plate provided so as to be movable between an engagement position, at which the lock plate engages with a tongue plate inserted into a body of the device and holds the tongue plate within the body of the device, and a released position, at which the lock plate has been released from holding the tongue plate;

a lock member having a body portion provided so as to be able to oscillate between a locking position, at which the body portion engages with the lock plate positioned at the engagement position and prevents the lock plate from moving toward the released position, and an unlocked position, at which the body portion has been released from preventing movement of the lock plate, and a shaft that supports the body portion at the body of the device;

a release button that is provided at the body of the device and that causes the body portion of the lock member to oscillate toward the unlocked position when the release button is operated by being pressed;

a lock spring that is provided between the release button and the body portion of the lock member and that urges the body portion of the lock member toward the locking position; and a holder, formed from a resin, that is provided between the body portion of the lock member and the lock spring and is engaged with one end of the lock spring.

* * * * *